US010295175B2

(12) United States Patent
Colannino et al.

(10) Patent No.: US 10,295,175 B2
(45) Date of Patent: May 21, 2019

(54) TRANSIENT CONTROL OF A COMBUSTION REACTION

(71) Applicant: ClearSign Combustion Corporation, Seattle, WA (US)

(72) Inventors: Joseph Colannino, Bellevue, WA (US); Richard F. Rutkowski, Seattle, WA (US); Igor A. Krichtafovitch, Kirkland, WA (US); David B. Goodson, Bellevue, WA (US); Christopher A. Wiklof, Everett, WA (US)

(73) Assignee: CLEARSIGN COMBUSTION CORPORATION, Seattle, WA (US)

( * ) Notice: Subject to any disclaimer, the term of this patent is extended or adjusted under 35 U.S.C. 154(b) by 423 days.

(21) Appl. No.: 15/069,268

(22) Filed: Mar. 14, 2016

(65) Prior Publication Data

US 2016/0273763 A1 Sep. 22, 2016

Related U.S. Application Data

(63) Continuation of application No. PCT/US2014/048138, filed on Jul. 25, 2014.

(Continued)

(51) Int. Cl.

*F23C 99/00* (2006.01)
*F23N 5/00* (2006.01)

(Continued)

(52) U.S. Cl.

CPC ..... *F23C 99/001* (2013.01); *F23N 5/003* (2013.01); *F23N 5/123* (2013.01); *F23N 5/203* (2013.01);

(Continued)

(58) Field of Classification Search

CPC ..... F23N 5/003; F23N 5/123; F23N 5/203; F23N 2023/52; F23N 2900/05006;

(Continued)

(56) References Cited

U.S. PATENT DOCUMENTS 2,604,936 A 7/1952 Kaehni et al.
3,004,137 A 10/1961 Karlovitz (Continued)

FOREIGN PATENT DOCUMENTS

EP 0844434 5/1998
EP 1139020 8/2006

(Continued)

OTHER PUBLICATIONS

James Lawton and Felix J. Weinberg. "Electrical Aspects of Combustion." Clarendon Press, Oxford. 1969, p. 81.

(Continued)

*Primary Examiner* — Alfred Basichas
(74) *Attorney, Agent, or Firm* — Christopher A. Wiklof; Nicholas S. Bromer; Launchpad IP, Inc.

(57) ABSTRACT

Technologies are provided for applying energy to a combustion reaction. For example, a method may include supporting a combustion reaction; applying energy to the combustion reaction via one or more control signals; detecting a change in one or more parameters associated with the combustion reaction; comparing the change in the one or more parameters to a database; determining whether the change in the one or more parameters corresponds to a change in the combustion reaction; selecting a change in the one or more control signals from the database; and applying the change in the one or more control signals to change the a value of the energy applied to the combustion reaction responsive to changes in the one or more parameters associated with in the combustion reaction.

21 Claims, 3 Drawing Sheets

Related U.S. Application Data

(60) Provisional application No. 61/877,921, filed on Sep. 13, 2013.

(51) Int. Cl.
*F23N 5/12* (2006.01)
*F23N 5/20* (2006.01)

(52) U.S. Cl.
CPC ..... *F23N 2023/52* (2013.01); *F23N 2900/05006* (2013.01)

(58) Field of Classification Search
CPC ... F23N 5/265; F23N 5/00; F23N 5/12; F23C 99/001; F23C 5/14; F23D 14/84; H01T 23/00
See application file for complete search history.

(56) References Cited

U.S. PATENT DOCUMENTS

| | | | | |
|---|---|---|---|---|
| 3,087,472 | A | 4/1963 | Yukichi | |
| 3,167,109 | A | 1/1965 | Wobig | |
| 3,224,485 | A | 12/1965 | Blomgren, Sr. et al. | |
| 3,269,446 | A | 8/1966 | Luther | |
| 3,306,338 | A | 2/1967 | Wright et al. | |
| 3,358,731 | A | 12/1967 | Donnelly | |
| 3,373,306 | A | 3/1968 | Karlovitz | |
| 3,416,870 | A | 12/1968 | Wright | |
| 3,749,545 | A | 7/1973 | Velkoff | |
| 3,841,824 | A | 10/1974 | Bethel | |
| 4,020,388 | A | 4/1977 | Pratt, Jr. | |
| 4,041,922 | A * | 8/1977 | Abe | F02B 19/12 123/143 B |
| 4,091,779 | A | 5/1978 | Suafferer et al. | |
| 4,111,636 | A | 9/1978 | Goldberg | |
| 4,201,140 | A | 5/1980 | Robinson | |
| 4,404,616 | A | 9/1983 | Miyanaka et al. | |
| 4,430,024 | A | 2/1984 | Guild et al. | |
| 5,515,681 | A | 5/1996 | DeFreitas | |
| 5,702,244 | A | 12/1997 | Goodson et al. | |
| 5,784,889 | A | 7/1998 | Joos et al. | |
| 7,137,808 | B2 | 11/2006 | Branston et al. | |
| 7,159,646 | B2 | 1/2007 | Dessiatoun et al. | |
| 7,243,496 | B2 | 7/2007 | Pavlik et al. | |
| 7,523,603 | B2 | 4/2009 | Hagen et al. | |
| 7,845,937 | B2 | 12/2010 | Hammer et al. | |
| 7,944,678 | B2 | 5/2011 | Kaplan et al. | |
| 8,245,951 | B2 | 8/2012 | Fink et al. | |
| 8,310,801 | B2 | 11/2012 | McDonald et al. | |
| 8,851,882 | B2 | 10/2014 | Hartwick et al. | |
| 8,881,535 | B2 | 11/2014 | Hartwick et al. | |
| 8,911,699 | B2 | 12/2014 | Colannino et al. | |
| 9,062,882 | B2 | 6/2015 | Hangauer et al. | |
| 9,151,549 | B2 | 10/2015 | Goodson et al. | |
| 9,209,654 | B2 | 12/2015 | Colannino et al. | |
| 9,267,680 | B2 | 2/2016 | Goodson et al. | |
| 9,284,886 | B2 | 3/2016 | Breidenthal et al. | |
| 9,289,780 | B2 | 3/2016 | Goodson | |
| 9,310,077 | B2 | 4/2016 | Breidenthal et al. | |
| 9,366,427 | B2 | 6/2016 | Sonnichsen et al. | |
| 9,371,994 | B2 | 6/2016 | Goodson et al. | |
| 9,377,188 | B2 | 6/2016 | Ruiz et al. | |
| 9,377,189 | B2 | 6/2016 | Ruiz et al. | |
| 9,377,195 | B2 | 6/2016 | Goodson et al. | |
| 9,441,834 | B2 | 9/2016 | Colannino et al. | |
| 9,453,640 | B2 | 9/2016 | Krichtafovitch et al. | |
| 9,469,819 | B2 | 10/2016 | Wiklof | |
| 9,494,317 | B2 | 11/2016 | Krichtafovitch et al. | |
| 9,496,688 | B2 | 11/2016 | Krichtafovitch et al. | |
| 9,513,006 | B2 | 12/2016 | Krichtafovitch et al. | |
| 2002/0092302 | A1 | 7/2002 | Johnson et al. | |
| 2005/0208442 | A1 | 9/2005 | Heiligers et al. | |
| 2005/0208446 | A1 | 9/2005 | Jayne | |
| 2006/0060176 | A1 * | 3/2006 | Yamashita | F02P 3/045 123/609 |
| 2006/0165555 | A1 | 7/2006 | Spielman et al. | |
| 2007/0020567 | A1 | 1/2007 | Branston et al. | |
| 2010/0183424 | A1 | 7/2010 | Roy | |
| 2011/0072786 | A1 | 3/2011 | Tokuda et al. | |
| 2012/0156628 | A1 | 6/2012 | Lochschmied et al. | |
| 2013/0004902 | A1 | 1/2013 | Goodson et al. | |
| 2013/0071794 | A1 | 3/2013 | Colannino et al. | |
| 2013/0230810 | A1 | 9/2013 | Goodson et al. | |
| 2013/0260321 | A1 | 10/2013 | Colannino et al. | |
| 2013/0291552 | A1 | 11/2013 | Smith et al. | |
| 2013/0323661 | A1 | 12/2013 | Goodson et al. | |
| 2013/0333279 | A1 | 12/2013 | Osler et al. | |
| 2013/0336352 | A1 | 12/2013 | Colannino et al. | |
| 2014/0051030 | A1 | 2/2014 | Colannino et al. | |
| 2014/0065558 | A1 | 3/2014 | Colannino et al. | |
| 2014/0076212 | A1 | 3/2014 | Goodson et al. | |
| 2014/0080070 | A1 | 3/2014 | Krichtafovitch et al. | |
| 2014/0162195 | A1 | 6/2014 | Lee et al. | |
| 2014/0162197 | A1 | 6/2014 | Krichtafovitch et al. | |
| 2014/0162198 | A1 | 6/2014 | Krichtafovitch et al. | |
| 2014/0170569 | A1 | 6/2014 | Anderson et al. | |
| 2014/0170571 | A1 | 6/2014 | Casasanta, III et al. | |
| 2014/0170575 | A1 | 6/2014 | Krichtafovitch | |
| 2014/0170576 | A1 | 6/2014 | Colannino et al. | |
| 2014/0170577 | A1 | 6/2014 | Colannino et al. | |
| 2014/0196368 | A1 | 7/2014 | Wiklof | |
| 2014/0208758 | A1 | 7/2014 | Breidenthal et al. | |
| 2014/0212820 | A1 | 7/2014 | Colannino et al. | |
| 2014/0216401 | A1 | 8/2014 | Colannino et al. | |
| 2014/0227645 | A1 | 8/2014 | Krichtafovitch et al. | |
| 2014/0227646 | A1 | 8/2014 | Krichtafovitch et al. | |
| 2014/0227649 | A1 | 8/2014 | Krichtafovitch et al. | |
| 2014/0248566 | A1 | 9/2014 | Krichtafovitch et al. | |
| 2014/0255855 | A1 | 9/2014 | Krichtafovitch | |
| 2014/0255856 | A1 | 9/2014 | Colannino et al. | |
| 2014/0272731 | A1 | 9/2014 | Breidenthal et al. | |
| 2014/0287368 | A1 | 9/2014 | Krichtafovitch et al. | |
| 2014/0295094 | A1 | 10/2014 | Casasanta, III | |
| 2014/0295360 | A1 | 10/2014 | Wiklof | |
| 2014/0335460 | A1 | 11/2014 | Wiklof et al. | |
| 2015/0079524 | A1 | 3/2015 | Colannino et al. | |
| 2015/0107260 | A1 | 4/2015 | Colannino et al. | |
| 2015/0118629 | A1 | 4/2015 | Colannino et al. | |
| 2015/0121890 | A1 | 5/2015 | Colannino et al. | |
| 2015/0140498 | A1 | 5/2015 | Colannino | |
| 2015/0147704 | A1 | 5/2015 | Krichtafovitch et al. | |
| 2015/0147705 | A1 | 5/2015 | Colannino et al. | |
| 2015/0219333 | A1 | 8/2015 | Colannino et al. | |
| 2015/0276211 | A1 | 10/2015 | Colannino et al. | |
| 2015/0338089 | A1 | 11/2015 | Krichtafovitch et al. | |
| 2015/0345780 | A1 | 12/2015 | Krichtafovitch | |
| 2015/0345781 | A1 | 12/2015 | Krichtafovitch et al. | |
| 2015/0362178 | A1 | 12/2015 | Karkow et al. | |
| 2016/0018103 | A1 | 1/2016 | Karkow et al. | |
| 2016/0033125 | A1 | 2/2016 | Krichtafovitch et al. | |
| 2016/0040872 | A1 | 2/2016 | Colannino et al. | |
| 2016/0091200 | A1 | 3/2016 | Colannino et al. | |
| 2016/0138800 | A1 | 5/2016 | Anderson et al. | |
| 2016/0161110 | A1 | 6/2016 | Krichtafovitch et al. | |
| 2016/0161115 | A1 | 6/2016 | Krichtafovitch et al. | |

FOREIGN PATENT DOCUMENTS

| | | |
|---|---|---|
| FR | 2577304 | 12/1989 |
| GB | 932955 | 7/1963 |
| JP | 58-019609 | 2/1983 |
| JP | 61-265404 | 11/1986 |
| JP | H 07-48136 | 2/1995 |
| WO | 1996/001394 | 1/1996 |
| WO | WO 2013/181569 | 12/2013 |

OTHER PUBLICATIONS

PCT International Search Report and Written Opinion of International PCT Application No. PCT/US2014/048138 dated Nov. 21, 2014.

(56) References Cited

OTHER PUBLICATIONS

F. Altendorfner et al., Electric Field Effects on Emissions and Flame Stability with Optimized Electric Field Geometry, The European Combustion Meeting ECM 2007, 2007, Fig. 1, Germany.
James Lawton and Felix J. Weinberg. "Electrical Aspects of Combustion." Clarendon Press, Oxford. 1969, p. 141, formula 4.131a.
M. Zake et al., "Electric Field Control of NOx Formation in the Flame Channel Flows." Global Nest: the Int. J. May 2000, vol. 2, No. 1, pp. 99-108.

* cited by examiner

TRANSIENT CONTROL OF A COMBUSTION REACTION

CROSS REFERENCE TO RELATED APPLICATIONS

The present application is a U.S. Continuation Application which claims priority benefit under 35 U.S.C. § 120 (pre-AIA) of co-pending International Patent Application No. PCT/US2014/048138, entitled "TRANSIENT CONTROL OF A COMBUSTION REACTION," filed Jul. 25, 2014; which application claims priority benefit from U.S. Provisional Patent Application No. 61/877,921, entitled "TRANSIENT CONTROL OF A COMBUSTION REACTION," filed Sep. 13, 2013, co-pending at the date of filing; each of which, to the extent not inconsistent with the disclosure herein, is incorporated herein by reference.

SUMMARY

In an embodiment, a system for applying a charge to a combustion reaction is provided. The system includes one or more first charge elements, each configured to apply a charge to a combustion reaction. The system includes a high voltage power supply including one or more outputs operatively coupled to the one or more first charge elements. The high voltage power supply can be configured to apply one or more control signals to the one or more first charge elements to apply the charge to the combustion reaction. The system can include one or more sensors configured to sense one or more parameters associated with the combustion reaction. The system can include a controller operatively coupled to the high voltage power supply and the one or more sensors. The controller can be configured to cause a change in the one or more control signals responsive to changes in the one or more parameters associated with the combustion reaction.

In an embodiment, a method for applying energy to control a combustion reaction is provided. The method may include supporting a combustion reaction. The method includes applying energy to the combustion reaction via one or more control signals, detecting a change in one or more parameters associated with the combustion reaction, and comparing the change in the one or more parameters to a database. The database includes data corresponding to changes to the control signal(s) to be made responsive to changes in the one or more parameters. The method further includes determining whether the change in the one or more parameters corresponds to a change in the combustion reaction and selecting data corresponding to the change in the control signal(s) from the database. The method includes applying the change in the one or more control signals to change a value of the energy applied to the combustion reaction responsive to the changes in the one or more parameters.

DETAILED DESCRIPTION

Figure 1:
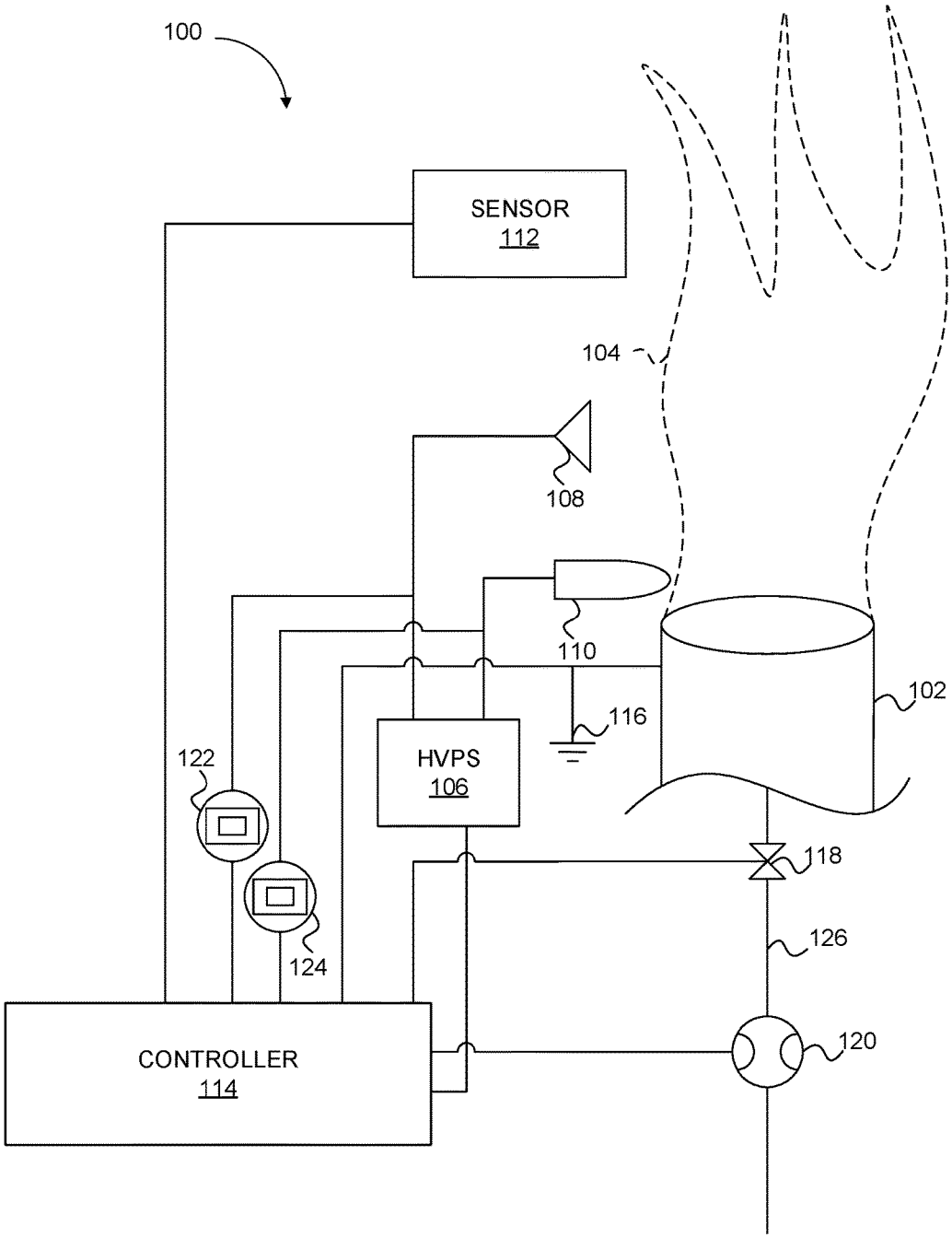
FIG. 1 is a block diagram of a system for applying energy to a combustion reaction, according to an embodiment.

In the following detailed description, reference is made to the accompanying drawings, which form a part hereof. In the drawings, similar symbols typically identify similar components, unless context dictates otherwise. Other embodiments may be used and/or other changes may be made without departing from the spirit or scope of the disclosure.

Use of the term charge element in the specification or claims is to be construed as including within its scope any element positioned and configured to apply energy, such as a charge, a voltage, an electric field, etc., to a combustion reaction, unless explicitly indicated otherwise. Examples of charge elements include corona discharge electrodes, dull electrodes, counter electrodes, field electrodes, field grids, etc. Additionally, many elements that have other functions in a combustion system can be configured to act as charge elements, including, for example, the fuel nozzle of a burner, side walls of a combustion chamber, a surface of a heat transfer element, etc., and where so configured, also fall within the scope of the term.

Where employed by the specification or claims to refer to a quantity that is applied to a combustion reaction via a charge element, the term energy is to be construed as including within its scope any form of energy or potential energy that might reasonably be applied to the combustion reaction, given the structure and configuration of the charge element upon which the language in question can be read, and may include, for example, electrical energy, electromagnetic energy, a charge, a voltage, an electrical field, etc.

Energy can be applied to a combustion reaction via one or more charge elements in order to control aspects of the combustion reaction. The efficacy of such control may be disturbed by changes in various conditions that affect the combustion reaction, such as temperature, pressure, fuel flow, fuel/oxidizer ratio, etc. Consequently, simply applying a particular combination of charge, voltage, or electric field can be insufficient to control the combustion reaction with the desired efficacy in view of such changes.

FIG. 1 is a block diagram of a system 100 for applying energy to a combustion reaction, according to an embodiment. The system 100 includes one or more first charge elements 108 configured to apply energy to a combustion reaction 104. The system 100 includes a high voltage power supply 106 including one or more outputs operatively coupled to the one or more first charge elements 108. The high voltage power supply 106 is configured to apply one or more control signals to the one or more first charge elements 108 to apply the energy to the combustion reaction 104. The system 100 includes one or more sensors 112 configured to sense one or more parameters associated with the combustion reaction 104. A controller 114 is included and operatively coupled to the high voltage power supply 106 and the one or more sensors 112. In the embodiment shown, the controller 114 is coupled to ground 116. However, in some embodiments, the controller 114 is electrically isolated from ground 116.

According to an embodiment, each of the one or more sensors 112 provides data corresponding to a respective parameter value, or to a change in the respective parameter value, and the controller 114 acts on the data. The sensor 112 provides either the parameter value (in a proportional control embodiment) or a difference between a previous parameter value and the current parameter value (in a differential control embodiment) as parameter input data, to a database of the controller 114. In the event of a deviation of a parameter value from a selected optimum value, the database returns a signal value of one or more of the one or more control signals, such as, for example, a new voltage value (in a DC voltage embodiment) or a new digital waveform (in an AC or chopped DC voltage embodiment) to drive the high voltage power supply in a way that will tend to move the value of the particular parameter of the combustion system toward the selected value, responsive to the change in the parameter value.

The controller 114 is configured to cause a change in the one or more control signals responsive to the parameter input data from the sensor 112 corresponding to undesirable changes in the one or more parameters associated with the combustion reaction 104. In an embodiment, the controller 114 is configured to compare parameter input data corresponding to values of the one or more parameters to the database using the parameter input data as independent variables such as by using each datum as an address for reading the database. The database carries operative links between values of the one or more parameters and corresponding values of the one or more control signals as output variables. The controller 114 is configured to use the output variables from the database to control the high voltage power supply 106 to apply the corresponding values as the one or more control signals to the one or more first charge elements 108. Where a parameter value has deviated from a selected optimum value, the value of the corresponding control signal is selected to drive the parameter toward the optimum value.

Many of the parameters of a combustion reaction are interactive, meaning that variations in one parameter can provoke changes in another parameter. For example, an increase in the flow rate of combustion fluid might cause subsequent changes in temperature, irradiance, combustion efficiency, and emission gas production. Where a controller is configured to respond to each of these parameters separately, it may adjust several different control signals, resulting in an overcorrection. Thus, according to an embodiment, the controller 114 is configured to select the values of the control signals in accordance with combinations of parameter input data values and/or the sequence in which parameter values change.

In an embodiment, the one or more parameters that may be detected by a sensor 112 can include a temperature, a pressure, an irradiance, a voltage and/or a charge, an electric field, an electrode gain, a waveform, a digital image of the combustion reaction, a digital video image of the combustion reaction, a fuel concentration, a fuel flow rate, a fuel consumption rate, an oxidant concentration, an oxidant flow rate, an oxidant consumption rate, a combustion product concentration, a combustion product flow rate, a combustion product production rate and/or a combustion reaction rate. Inasmuch as changes in the one or more parameters associated with the combustion reaction 104 may include transients, the controller 114 can be configured to provide a delayed response, or to provide a response that varies over time, for a given parameter value.

Each of the one or more parameters can be measured directly or can be inferred from direct measurement. For example, a voltage can be measured directly at one of the one or more first charge elements 108 via one of the one or more sensors 112 configured as a contact voltage sensor. Likewise, temperature at various locations within a combustion chamber can be measured directly via temperature sensors. On the other hand, for example, an effective voltage can be inferred for the one or more first charge elements 108 from a corresponding electric field measured in proximity to the one or more first charge elements 108 via one of the one or more sensors 112 configured as an electric field sensor, or a fuel flow rate can be inferred from pressure values measured at multiple points in a flow channel having known pressure drop characteristics.

In an embodiment, the controller 114 can be configured as, or to include one or more of a microcontroller, a field-programmable gate array, a local host for a networked controller, a neural network, a fuzzy logic controller, and/or an emulator thereof executed on a general purpose computer.

In an embodiment, the database includes one or more of a look-up table, a relational database, a fuzzy logic database, a model embedded in a neural network, and/or a model embedded in a field-programmable gate array.

In an embodiment, the system 100 includes a fuel flow meter 120 operatively coupled to the controller 114 and the burner and/or fuel source 102, and configured to provide a signal corresponding to a rate of flow in a fuel line 126. The system 100 includes a fuel controller 118 operatively coupled to the controller 114, the fuel flow meter 120, the burner and/or fuel source 102, configured to regulate the rate of flow in the fuel line 126 in accordance with a control signal provided by the controller 114. The fuel flow meter 120 is configured to report a fuel flow rate to the controller 114, which is configured to receive the fuel flow rate reported by the fuel flow meter 120 as a parameter input datum. The controller 114 is configured to control the fuel flow rate via the fuel controller 118, and may control the fuel controller 118 in response to values of the fuel flow rate and/or additional parameter input data. For example, where other parameter input data indicate an excessive combustion reaction temperature, or a reduction in oxidant flow rate, the controller 114 may control the fuel controller 118 to reduce the fuel flow rate, even though the value of the fuel flow rate may be otherwise acceptable.

According to various embodiments, the system 100 includes one or more second charge elements 110, one or more first sensors 122, and one or more second sensors 124. These elements are discussed in more detail below with reference to FIG. 2.

Figure 2:
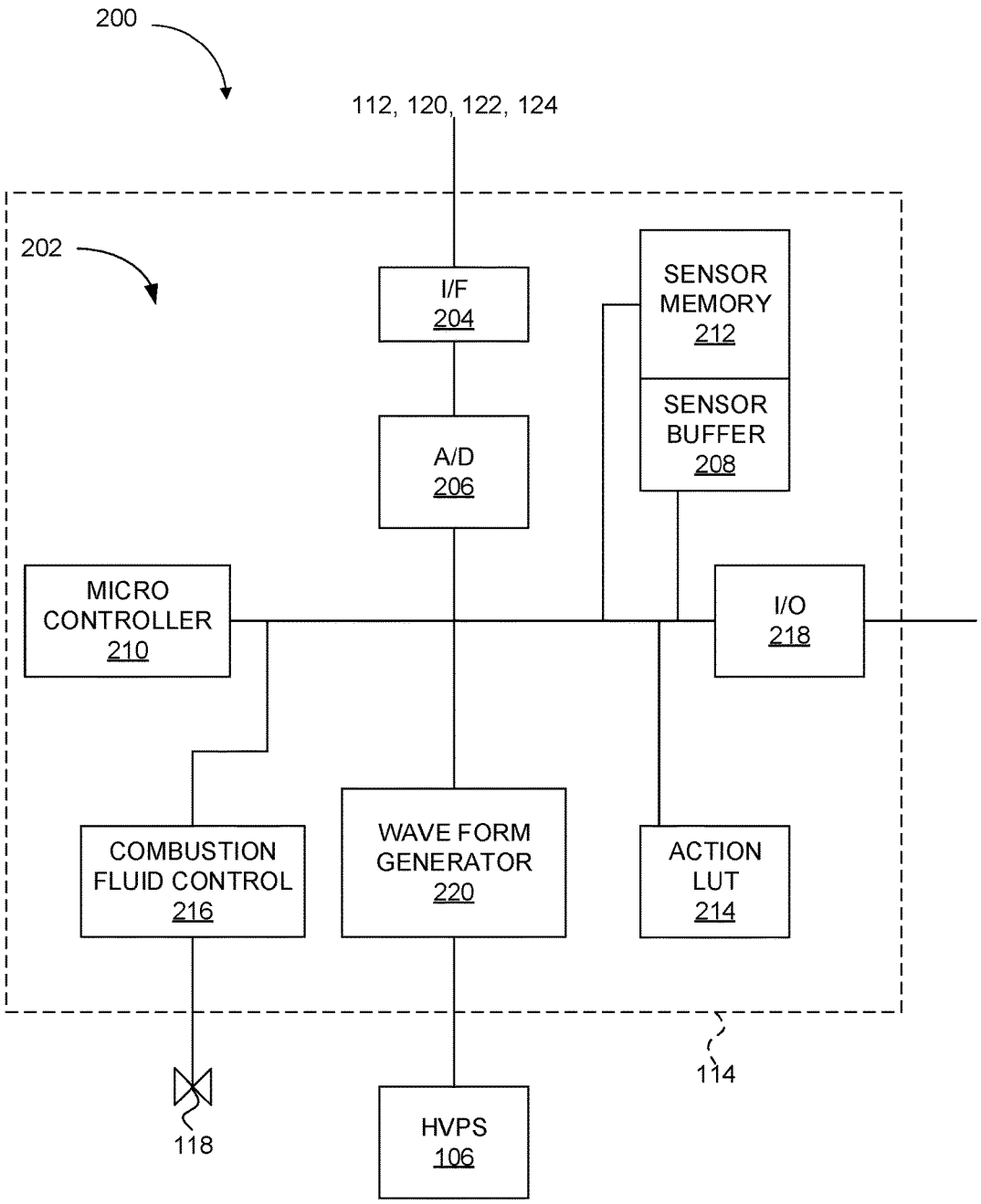
FIG. 2 is a block diagram depicting additional details for a controller for applying energy to a combustion reaction, according to an embodiment.

FIG. 2 is a block diagram 200 depicting control components 202 which can be included in the system 100, for example, as part of the controller 114, for applying energy to a combustion reaction, according to an embodiment. In the embodiment shown, the control components 202 include a sensor interface 204, an analog to digital converter 206, a sensor buffer 208, a sensor memory 212, an action look up table 214, a fuel flow controller 216, a data interface 218, a digital microcontroller 210, and a waveform generator 220.

The sensor interface 204 is operatively coupled to the one or more first sensors 122 and the one or more second sensors 124, and can be operatively coupled to the one or more combustion sensors 112, the fuel controller 118, and the fuel flow meter 120. The analog to digital converter 206 is operatively coupled to the sensor interface 204. The sensor buffer 208 is operatively coupled to receive digital signals from the analog to digital converter 206. The sensor memory 212 is operatively coupled to receive and store digital signals from one or more of the sensor buffer and/or the analog to digital converter 206. The action look up table 214 may be configured to include the database. Alternatively, the database can be incorporated as part of another one of the components of the controller, or can be a stand-alone component, operatively coupled to the look up table 214 and such other components as is appropriate for the particular configuration. The fuel flow controller 216 is operatively coupled to the fuel controller 118. The data interface 218 is configured to receive input from and direct output to a human or a computer. The digital microcontroller 210 is operatively coupled to the analog to digital converter 206, the sensor buffer 208, the sensor memory 212, the action look up table 214, the fuel flow controller 216, and the data interface 218.

In another embodiment, the sensor(s) 112, 120, 122, 124 outputs a digital signal and the analog-to-digital converter 206 can be omitted. In a particular embodiment, the combustion sensor 112 includes a digital video camera or digital still camera configured to deliver image frames to the interface 204. For example, the image frames can include visible light or infrared light images of the combustion reaction. In an embodiment, the image frames are received. It has been found that in some cases, individual image frames are too chaotic to be analyzed individually. To overcome the chaotic nature of individual frames, the individual frames are frame-averaged. Individual frames are loaded into the sensor buffer. The microcontroller 210 performs frame averaging on a group of frames to determine an average frame in the group. For example, 5 successive frames can be averaged to form an average image frame for the group of 5 successive frames. In another embodiment, 20 successive frames are averaged. In an embodiment, a characteristic variation between the group of frames that are averaged can be used as a parameter. For example, a pixel-by-pixel or a global standard deviation of pixel values between frames in the group can be used to determine a degree of chaos compared to the averaged frame.

Various performance parameters can be deduced from analysis of video images of the combustion reaction. Combustion reaction location can be deduced from an averaged frame. Referring to FIGS. 1 and 2, a charge element 108 configured as a field electrode can be driven to an increased repulsion voltage if the controller 114 makes a determination that the combustion reaction is too close to a steam tube corresponding to the location of the charge element 108. Combustion reaction mixture can be deduced from a detected color of the combustion reaction. For example, a yellow methane flame can be associated with too little oxidant. Accordingly, the controller can drive a blower (not shown) to a higher flow rate to increase a flow of air containing oxygen. In another example, a flame with thin blue tendrils extending to a flame holding electrode 110 can be determined stable with sufficient (e.g., frame averaged) blue area or can be determined to be relatively unstable with insufficient blue area. Voltage(s) output by the high voltage power supply 106 can be adjusted responsive to stability of the flame (combustion reaction). Alternatively, a waveform output at a given voltage can be adjusted to stabilize an unstable flame or to reduce power consumption for holding a stable flame.

The waveform generator 220 is operatively coupled to the controller 114 and the high voltage power supply 106 and configured to generate one or more waveforms. The waveform generator 220 can be configured, together with the controller 114, to drive the one or more outputs of the high voltage power supply 106 with the one or more waveforms such that the one or more control signals include the one or more waveforms.

In an embodiment, the waveform generator 220 can be configured to generate one or more waveforms. For example, in various embodiments, the waveform generator 220 can be configured to generate an alternating current (AC) voltage waveform, a sinusoidal waveform, a square waveform, a sawtooth waveform, a triangular waveform, a wavelet waveform, a logarithmic waveform and/or an exponential waveform. The waveform generator 220 can be configured to generate a truncated waveform, for example, a truncated version of any of the preceding waveforms. The waveform generator 220 can be configured to generate combination waveform, for example, a combination waveform of any two or more of the preceding waveforms.

In an embodiment, the database can include a plurality of changes in the one or more control signals including the one or more waveforms operatively linked to the plurality of changes in the one or more parameters.

In an embodiment, the controller 114 can be configured to compare the one or more parameters to the database to select the change in the one or more control signals including a first waveform. The controller 114 can be configured to control the waveform generator 220 to generate the first waveform and provide the first waveform to the high voltage power supply 106. The controller 114 can be configured to control the high voltage power supply 106 to apply the change in the one or more control signals including the first waveform to one or more of the one or more first charge elements 108 and/or the one or more second charge elements 110, thereby controlling the change in the combustion reaction 104.

In an embodiment, each of the one or more first charge elements 108 can be configured, for example, as a field electrode, a charge electrode, or a corona electrode. The system 100 can include one or more first sensors 122 operatively coupled to each of the one or more first charge elements 108 and the controller 114 can be configured to detect energy applied to each of the one or more first charge elements 108 by the high voltage power supply 106.

In an embodiment, the controller 114 can be coupled to the high voltage power supply 106 and electrically isolated from ground such that the controller 114 floats at an applied voltage of the high voltage power supply 106. The controller 114 can be coupled to the one or more first sensors 122 and the one or more first charge elements 108. The controller 114 can be configured to sense a current or a differential voltage corresponding to the one or more first charge elements 108. The controller 114 can be configured to calculate an absolute voltage versus ground 116 that includes the applied voltage and the differential voltage.

In an embodiment, one or more of the one or more first charge elements 108 can be configured as a corona electrode. The controller 114 can be configured to detect a change in a voltage at the corona electrode via the one or more first sensors 122. The controller 114 can be configured to cause a change in a voltage applied to the corona electrode by the high voltage power supply 106 responsive to the change in the voltage at the corona electrode. The controller 114 can be configured to detect a short at the corona electrode via the one or more first sensors 122. The controller 114 can be configured to reduce the voltage applied to the corona electrode by the high voltage power supply 106 responsive to the short at the corona electrode. The controller 114 can be configured to de-energize the corona electrode responsive to the short at the corona electrode.

In an embodiment, one or more of the one or more first charge elements 108 can be configured as the field electrode. The controller 114 can be configured to apply a voltage to the field electrode. The controller 114 can be configured to detect a change in a back electromotive force at the field electrode via the one or more first sensors 122. The controller 114 can be configured to cause a change in the voltage applied to the field electrode by the high voltage power supply 106 responsive to the change in the back electromotive force at the field electrode. The change in the back electromotive force can be associated with a change in the combustion reaction. The controller 114 can be configured to control the change in the combustion reaction in a feedback loop that can include the change in the back electromotive force and a corresponding change in the voltage applied to the field electrode.

In an embodiment, the system includes one or more second charge elements 110 operatively coupled to the high voltage power supply 106. The one or more second charge elements 110 can be configured together with the controller, the high voltage power supply 106, and the one or more first charge elements 108 to apply the change in the one or more control signals to the combustion reaction 104.

In an embodiment, each of the one or more first charge elements 108 is configured as a field electrode or a charge electrode, and at least one of the one or more second charge elements 110 is configured as a corona electrode.

In an embodiment, at least one of the one or more second charge elements 110 is in closer proximity to the burner or fuel source 102 compared to at least one of the one or more first charge elements 108.

In an embodiment, the one or more first charge elements 108, the one or more second charge elements 110, and the high voltage power supply 106 can be together configured to at least intermittently form a complete electrical circuit in contact with the combustion reaction 104.

In an embodiment, the system 100 includes a respective one of the one or more second sensors 124, operatively coupled to each of the one or more second charge elements 110 and the controller 114, configured to detect energy applied to the corresponding one of the one or more second charge elements 110 by the high voltage power supply 106. Each of the first and second isolating sensors 122 and 124 can be configured as a voltage sensor or a current sensor. Each of the first and second sensors 122 and 124 can also be electrically isolated from the controller 114 and/or ground 116 via optocoupler, transformer, or any other appropriate means of isolation.

In an embodiment, the one or more control signals can include a charge, a voltage, an electrical field, or a combination thereof. The one or more control signals can include one or more of: a time-varying majority charge, a time-varying voltage, and/or a time varying electric field, or a combination thereof.

In an embodiment, the combustion reaction 104 can include a flame.

In an embodiment, the system 100 includes the burner or fuel source 102 conductively coupled to the high voltage power supply 106 such that the one or more first charge elements 108, the high voltage power supply 106, and the burner or fuel source 102 can be configured together to at least intermittently form a complete circuit in contact with the combustion reaction 104.

Figure 3:
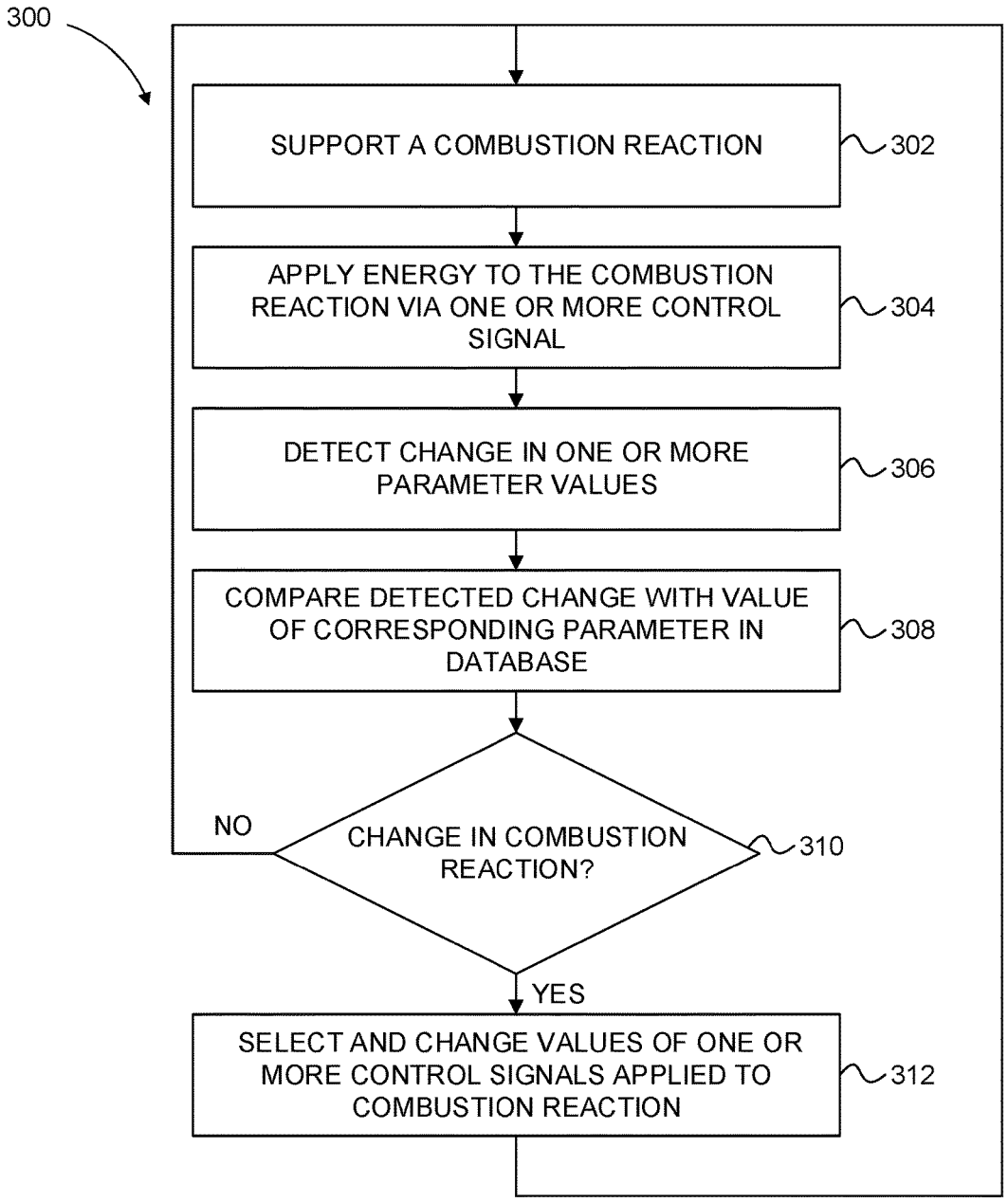
FIG. 3 is a flow diagram of a method for applying a charge to control a combustion reaction, according to an embodiment.

FIG. 3 is a flow diagram of a method 300 for applying energy to control a combustion reaction, according to an embodiment. In step 302 a combustion reaction is supported. In step 304 energy is applied to the combustion reaction via one or more control signals. Proceeding to step 306 a change is detected in one or more parameters associated with the combustion reaction. In step 308 the change in the one or more parameters is compared to a database. The database can include a plurality of changes in the one or more control signals operatively linked to a plurality of the changes in the one or more parameters. In step 310 it is determined whether the change in the one or more parameters corresponds to a change in the combustion reaction. In step 312 a change in the one or more control signals is selected from the database. Step 312 can include applying the change in the one or more control signals to change a value of the energy applied to the combustion reaction responsive to changes in the one or more parameters associated with in the combustion reaction.

In an embodiment, the method 300 can include employing a controller and a microcontroller. The controller can include a field-programmable gate array. The controller can include a local host for a networked controller, a neural network and/or a fuzzy logic controller. The controller can include an emulator of any of the preceding controllers executed on a general purpose computer. The controller can be programmed to carry out any of the steps described herein for method 300. For example, the controller can be programmed to carry out step 308 comparing the one or more parameters to the database. The controller can also be programmed to carry out step 310 determining whether the changes in the one or more parameters indicate the change in the combustion reaction. The method 300 can include employing the database including one or more of a look-up table, a relational database, a fuzzy logic database, a model embedded in a neural network, and/or a model embedded in a field-programmable gate array.

In an embodiment of the method 300, the step of detecting the one or more parameters associated with the combustion reaction can include detecting one or more of temperature, pressure, irradiance, a charge, voltage, an electric field, a digital image of the combustion reaction, a digital video image of the combustion reaction, an electrode gain and/or a waveform. The one or more parameters can include a fuel concentration, a fuel flow rate and/or a fuel consumption rate. The one or more parameters can include an oxidant concentration, an oxidant flow rate and/or an oxidant consumption rate. The one or more parameters can include a combustion product concentration, a combustion product flow rate, a combustion product production rate and/or a combustion reaction rate. The method 300 can include detecting a plurality of the one or more parameters associated with the combustion reaction. The plurality of changes in the one or more parameters associated with the combustion reaction can include one or more transients.

Some or all of the one or more parameters may be measured directly; for example, referring to FIG. 1, a voltage can be measured at one of the one or more first charge elements 108 via one of the one or more sensors 112 configured as a contact voltage sensor. Additionally or alternatively, some or all of the one or more parameters can be measured indirectly; for example, an effective voltage can be inferred for the one or more first charge elements 108 according to a corresponding electric field measured in proximity to the one or more first charge elements 108 via one of the one or more sensors 112 configured as an electric field sensor.

Referring again to FIG. 3, in an embodiment, the method 300 can include detecting a fuel flow rate to the combustion reaction. The method 300 can include controlling the fuel flow rate responsive to changes in the one or more parameters associated with in the combustion reaction. The method 300 can include generating one or more waveforms. The method 300 can include driving the combustion reaction with the one or more waveforms such that the one or more control signals can include the one or more waveforms.

In an embodiment, generating the one or more waveforms can include generating one or more periodic waveforms. Generating the one or more waveforms can include generating one or more of the following waveforms. The one or more waveforms can include an alternating current (AC) voltage waveform, a sinusoidal waveform, a square waveform, a sawtooth waveform, a triangular waveform, a wavelet waveform, a logarithmic waveform and/or an exponential waveform. The one or more waveforms can include a truncated waveform, for example a truncated waveform of any of the preceding waveforms. The one or more waveforms can include a combination waveform, for example, a combination of any two or more of the preceding waveforms. The database can include a plurality of changes in the one or more control signals including the one or more waveforms, operatively linked to the plurality of changes in the one or more parameters.

In an embodiment, the method 300 can include selecting the one or more control signals including a first waveform from the database upon comparing the changes in the one or more parameters to the database. The method 300 can include generating the first waveform. The method 300 can include applying the one or more control signals including the first waveform to the combustion reaction.

In an embodiment, the method 300 can include applying the energy to the combustion reaction via a field electrode, a charge electrode, or a corona electrode. The method 300 can include sensing the energy applied to the combustion reaction via the field electrode, the charge electrode, or the corona electrode. The method 300 can include applying the energy to the combustion reaction using a high voltage power supply coupled to the field electrode, the charge electrode, or the corona electrode.

In an embodiment, the method 300 can include isolating a sensor from ground and floating the sensor at an applied voltage of the high voltage power supply to the field electrode, the charge electrode, or the corona electrode. The method 300 can include sensing a current or a differential voltage corresponding to the field electrode, the charge electrode, or the corona electrode using the sensor. The method 300 can include calculating an absolute voltage versus ground that can include the applied voltage and the differential voltage. The method 300 can include sensing a change in a voltage at the corona electrode. The method 300 can include changing a voltage applied to the corona electrode responsive to the change in the voltage at the corona electrode. The method can further include detecting a short at the corona electrode (which can occur when an arc forms between the corona electrode and the combustion reaction), and reducing the voltage applied to the corona electrode responsive to the short at the corona electrode. The method 300 can include de-energizing the corona electrode responsive to the short at the corona electrode.

In an embodiment, the method 300 can include applying a voltage to the field electrode. The method 300 can include sensing a change in a back electromotive force at the field electrode. The method 300 can include changing the voltage applied to the field electrode responsive to the change in the back electromotive force at the field electrode. The change in the back electromotive force can be associated with a change in the combustion reaction. The method 300 can include controlling the change in the combustion reaction in a feedback loop that can include the change in the back electromotive force and a corresponding change in the voltage applied to the field electrode.

In an embodiment of the method 300, the one or more control signals can include a charge, a voltage, an electrical field, or a combination thereof. The one or more control signals can include one or more of: a time-varying majority charge, a time-varying voltage, and/or a time varying electric field, or a combination thereof.

In an embodiment of the method 300, the step of supporting the combustion reaction can include supporting a flame.

In an embodiment, applying the one or more control signals to the combustion reaction can include employing two or more charge elements. The step of applying the one or more control signals to the combustion reaction can include employing at least one of the two or more charge elements configured as a field electrode or a charge electrode. The step of applying the one or more control signals to the combustion reaction can include employing at least one of the two or more charge elements configured as a corona electrode. The method 300 can include providing at least one of the two or more charge elements in closer proximity to the combustion reaction compared to at least one other of the two or more charge elements.

In an embodiment of the method 300, the step of applying the one or more control signals to the combustion reaction includes changing a voltage modulation frequency or a charge modulation frequency. The step of applying the one or more control signals to the combustion reaction includes changing a voltage or a charge concentration. The step of applying the one or more control signals to the combustion reaction can include compensating for a change in one or more of a combustion reaction volume, an oxidant flow rate, a digital image of the combustion reaction, a digital video image of the combustion reaction, and/or a fuel flow rate.

In an embodiment, the method 300 can include detecting the one or more control signals via an electrically isolated sensor. The method 300 can include optically isolating the electrically isolated sensor.

While various aspects and embodiments have been disclosed herein, other aspects and embodiments are contemplated. The various aspects and embodiments disclosed herein are for purposes of illustration and are not intended to be limiting, with the true scope and spirit being indicated by the following claims.

What is claimed is:

1. A system for applying energy to a combustion reaction, comprising:

one or more first charge elements configured to apply energy to a combustion reaction;

a high voltage power supply including one or more outputs operatively coupled to the one or more first charge elements, the high voltage power supply configured to apply one or more control signals to the one or more first charge elements to apply energy to the combustion reaction;

one or more sensors configured to sense one or more parameters associated with the combustion reaction; and a controller operatively coupled to the high voltage power supply and the one or more sensors and configured to cause a change in the one or more control signals responsive to changes in the one or more parameters associated with the combustion reaction;

wherein each of the one or more first charge elements is configured as a field electrode, a charge electrode, or a corona electrode; and wherein a respective one of the one or more sensors is operatively coupled to each of the one or more first charge elements and the controller, and wherein the controller is configured to detect energy applied to each of the one or more first charge elements by the high voltage power supply.

2. The system for applying energy to a combustion reaction of claim 1, wherein the controller is configured to:

detect the changes in the one or more parameters from the one or more sensors;

compare the changes in the one or more parameters to a database that includes a plurality of changes in the one or more control signals operatively linked to a plurality of the changes in the one or more parameters;

select the change in the one or more control signals from the database responsive to the changes in the one or more parameters; and control the high voltage power supply to apply the change in the one or more control signals to the one or more first charge elements.

3. The system for applying energy to a combustion reaction of claim 2, wherein the one or more parameters include one or more of: a temperature, a pressure, an irradiance, a charge, a voltage, an electric field, an electrode gain, a waveform, a digital image of the combustion reaction, a digital video image of the combustion reaction, a fuel concentration, a fuel flow rate, a fuel consumption rate, an oxidant concentration, an oxidant flow rate, an oxidant consumption rate, a combustion product concentration, a combustion product flow rate, a combustion product production rate, or a combustion reaction rate.

4. The system for applying energy to a combustion reaction of claim 2, wherein the changes in the one or more parameters associated with the combustion reaction include one or more transients.

5. The system for applying energy to a combustion reaction of claim 2, wherein the controller is configured as one or more of a microcontroller, a field-programmable gate array, a local host for a networked controller, a neural network, a fuzzy logic controller, or an emulator thereof executed on a general purpose computer.

6. The system for applying energy to a combustion reaction of claim 2, wherein the database includes one or more of a look-up table, a relational database, a fuzzy logic database, a model embedded in a neural network, or a model embedded in a field-programmable gate array.

7. The system for applying energy to a combustion reaction of claim 2, further comprising:

a fuel flow meter operatively coupled to the controller and a burner or fuel source; and a fuel controller operatively coupled to the controller, the fuel flow meter, and the burner or fuel source, wherein:

the fuel flow meter is configured to report a fuel flow rate to the controller;

the controller is configured to receive the fuel flow rate reported by the fuel flow meter; and the controller is configured to control the fuel flow rate via the fuel controller.

8. The system for applying energy to a combustion reaction of claim 1, wherein the controller is:

coupled to the high voltage power supply and electrically isolated from ground such that the controller floats at an applied voltage of the high voltage power supply; and coupled to the one or more sensors and to the corresponding ones of the one or more first charge elements and configured to receive a signal corresponding to a current or a differential voltage of each of the one or more first charge elements.

9. The system for applying energy to a combustion reaction of claim 1, wherein:

one of the one or more first charge elements is configured as the corona electrode; and the controller is configured to:

detect a change in a voltage at the corona electrode via the one or more sensors; and cause a change in a voltage applied to the corona electrode by the high voltage power supply responsive to the change in the voltage at the corona electrode.

10. The system for applying energy to a combustion reaction of claim 1, wherein:

one of the one or more first charge elements is configured as the field electrode; and the controller is configured to:

apply a voltage to the field electrode;

detect a change in a back electromotive force at the field electrode via the one or more sensors; and cause a change in the voltage applied to the field electrode by the high voltage power supply responsive to the change in the back electromotive force at the field electrode.

11. The system for applying energy to a combustion reaction of claim 1, further comprising one or more second charge elements that is:

operatively coupled to the high voltage power supply; and configured together with the controller, the high voltage power supply, and the one or more first charge elements to apply the change in the one or more control signals to the combustion reaction.

12. The system for applying energy to a combustion reaction of claim 11, wherein:

each of the one or more first charge elements is configured as the field electrode or the charge electrode; and at least one or more second charge elements is configured as the corona electrode.

13. The system for applying energy to a combustion reaction of claim 1, wherein at least one or more second charge elements is in closer proximity to a burner or fuel source compared to at least one of the one or more first charge elements.

14. The system for applying energy to a combustion reaction of claim 1, wherein the one or more first charge elements, one or more second charge elements, and the high voltage power supply are together configured to at least intermittently form a complete electrical circuit in contact with the combustion reaction.

15. The system for applying energy to a combustion reaction of claim 14, further comprising one or more second sensors operatively coupled to each of the one or more second charge elements and the controller, wherein the controller is configured to detect energy applied to each of the one or more second charge elements by the high voltage power supply.

16. The system for applying energy to a combustion reaction of claim 1, wherein the one or more control signals include a charge, a voltage, an electric field, or a combination thereof.

17. The system for applying energy to a combustion reaction of claim 1, wherein the one or more control signals include one or more of:

a time-varying majority charge, a time-varying voltage, a time-varying electric field, or a combination thereof.

18. The system for applying energy to a combustion reaction of claim 1, wherein the combustion reaction includes a flame.

19. The system for applying energy to a combustion reaction of claim 1, further comprising a burner or fuel source.

20. The system for applying energy to a combustion reaction of claim 19, wherein the burner or fuel source is conductively coupled to the high voltage power supply such that the one or more first charge elements, the high voltage power supply, and the burner or fuel source are together configured to at least intermittently form a complete circuit in contact with the combustion reaction.

21. A system for applying energy to a combustion reaction, comprising:

one or more first charge elements configured to apply energy to a combustion reaction;

a high voltage power supply including one or more outputs operatively coupled to the one or more first charge elements, the high voltage power supply configured to apply one or more control signals to the one or more first charge elements to apply energy to the combustion reaction;

one or more sensors configured to sense one or more parameters associated with the combustion reaction; and a controller operatively coupled to the high voltage power supply and the one or more sensors and configured to cause a change in the one or more control signals responsive to changes in the one or more parameters associated with the combustion reaction;

wherein the controller is configured to:

detect the changes in the one or more parameters from the one or more sensors;

compare the changes in the one or more parameters to a database that includes a plurality of changes in the one or more control signals operatively linked to a plurality of the changes in the one or more parameters;

select the change in the one or more control signals from the database responsive to the changes in the one or more parameters; and control the high voltage power supply to apply the change in the one or more control signals to the one or more first charge elements and further comprising a waveform generator that is:

operatively coupled to the controller and the high voltage power supply;

configured to generate one or more waveforms; and configured together with the controller to drive the one or more outputs of the high voltage power supply with the one or more waveforms such that the one or more control signals include the one or more waveforms.

* * * * *